United States Patent [19]

Kono et al.

[11] Patent Number: 4,480,961

[45] Date of Patent: Nov. 6, 1984

[54] SWASH PLATE TYPE COMPRESSOR WITH A MALFUNCTION DETECTOR

[75] Inventors: Hiroya Kono; Jun Hasegawa; Hiroyuki Deguchi; Hisao Kobayashi, all of Kariya, Japan

[73] Assignee: Kabushiki Kaisha Toyoda Jidoshokki Seisakusho, Aichi, Japan

[21] Appl. No.: 439,642

[22] Filed: Nov. 5, 1982

[30] Foreign Application Priority Data

Nov. 11, 1981 [JP] Japan ..... 56-180910

[51] Int. Cl.[3] ..... F04B 49/02; F04B 49/06; F04B 1/26

[52] U.S. Cl. ..... 417/15; 417/223; 417/269

[58] Field of Search ..... 417/15, 223, 270, 269; 236/88

[56] References Cited

U.S. PATENT DOCUMENTS 3,197,003 7/1965 Yetter ..... 236/88
4,036,339 7/1977 Kibuchi ..... 236/88
4,303,196 12/1981 Raines ..... 236/88
4,355,959 10/1982 Kono et al. ..... 417/223
4,393,966 7/1983 Kono et al. ..... 417/223
4,407,448 10/1983 Yamanaka ..... 236/88

FOREIGN PATENT DOCUMENTS 120077 10/1978 Japan ..... 236/88
120082 10/1978 Japan ..... 236/88

*Primary Examiner*—William L. Freeh
*Attorney, Agent, or Firm*—Burgess, Ryan & Wayne

[57] ABSTRACT

A swash plate type compressor with a malfunction detector, the detector comprising a detected unit embedded in part of the outer periphery of the swash plate of the compressor and a detecting unit fixedly mounted on part of the combined cylinder block of the compressor. The detected unit has a thermosensor and a permanent magnet embedded inwardly from the thermosensor. The detecting unit has a fixed magnetic member and an electric coil wound around the magnetic member.

5 Claims, 8 Drawing Figures

SWASH PLATE TYPE COMPRESSOR WITH A MALFUNCTION DETECTOR

BACKGROUND OF THE INVENTION

The present invention relates to a swash plate type compressor, more particularly, to a swash plate type compressor with a malfunction detector.

DESCRIPTION OF THE PRIOR ART

In general, compressors for automotive air-conditioning have to be constantly supplied with sufficient amounts of refrigerant gas. Since the refrigerant gas normally contains lubricating oil, insufficient supply of refrigerant gas causes lack of lubrication to moving elements and parts in the compressors and resultant friction heat. The insufficient amount of the refrigerant gas itself means this heat generated inside the compressors cannot be suppressed. These combine to result in seizure of the moving elements and parts, bringing the compressors to a standstill.

Further, the compressors occasionally compress liquefied refrigerant gas, particularly at start up. This subjects the pistons of the compressors to excessive loads and sometimes causes piston breakage. Such breakage of the pistons sometimes causes the compressors to stop running.

Breakdown of the compressors for automotive air-conditioning not only results in cessation of, air-conditioning, but also leads to damage to water pumps, alternators, cooling fans, and other auxiliary equipment driven by the same belts as the compressors.

To prevent breakdown of compressors for automotive air-conditioning, various means for detecting malfunctions in compressors have been proposed and applied.

A typical compressor, a swash plate type, with a malfunction detector is disclosed in Unexamined Japanese Patent Publication (Kokai) No. 57-59170. In the compressor, the malfunction detector comprises a detected unit, comprising a thermosensor, such as a thermo-sensitive ferrite element, attached to the outer circumference of the swash plate, and a detecting unit, comprising a permanent magnet fixed to part of the cylinder block of the compressor and a coil wound around the permanent magnet.

The detecting unit is positioned so that when the swash plate is rotated, the detected unit passes close by the permanent magnet of the detecting unit. The detected unit periodically approaches the detecting unit due to the rotation of the swash plate. Such approaches change the density of the magnetic flux generated by the permanent magnet. This causes electromagnetic induction which generates an electric current in the coil of the detecting unit in the form of electric voltage pulses. The electric voltage pulses are electrically processed in an appropriate electric circuit to determine whether or not the compressor is running normally. As long as the compressor is running normally, the electric circuit maintains the connection of an electromagnetic clutch between the engine and the compressor drive shaft.

Any increase in the temperature inside the compressor beyond the Curie temperature of the thermosensitive ferrite element of the detected unit, however, diminishes or extinguishes the magnetism of the thermosensitive ferrite element. In such a case, the periodic approaches of the detected unit to the detecting unit will no longer change the density of the magnetic flux generated by the permanent magnet of the detecting unit. As a result, no appreciable electric current or only an extremely weak electric current will be generated in the coil of the detecting unit. When this happens, the afore-mentioned electric circuit sends a signal to disconnect the electromagnetic clutch, thereby stopping the operation of the swash plate type compressor.

Similarly, when the compressor breaks down due to, e.g., breakage of the pistons caused by excessive load during liquid compression, no electric current is generated in the coil at all. When this happens, the electric circuit also immediately sends a signal to disconnect the electromagnetic clutch and stop the operation of the compressor.

In the above conventional swash plate type compressor with a malfunction detector however, the electric voltage pulses derived from the detecting unit are of a rather low level. Therefore, the electric voltage pulses are highly succeptible to high level noise around the detecting unit. This makes it difficult to reliably detect malfunctions of the compressor.

SUMMARY OF THE INVENTION

The object of the present invention is to provide a swash plate type compressor with an improved malfunction detector.

In accordance with the present invention, there is provided a swash plate type compressor with a malfunction detector. The compressor includes a combined cylinder block comprising a pair of front and rear cylinder blocks axially combined with each other; a rotatable drive shaft centrally extending through the combined cylinder block, the rotatable drive shaft being connectable to a drive source via an electromagnetic clutch; a plurality of cylinder bores formed in the combined cylinder block arranged around the rotatable drive shaft; a plurality of compressor pistons slidably fitted in the plurality of cylinder bores; a swash plate chamber in the approximately middle portion of the combined cylinder block; and a swash plate in the swash plate chamber rotatably supported on the drive shaft, the swash plate causing reciprocal motions of the compressor pistons. The improvement consists of the fact that the malfunction detector comprises a detected unit having a thermosensor disposed in part of the outer periphery of the swash plate and a permanent magnet element embedded inwardly from and arranged adjacent to the thermosensor and comprises a detecting unit fixedly arranged in the combined cylinder block at a position where the detecting unit comes face to face with the detected unit once per revolution of the swash plate, the detecting unit comprising a fixed magnet and an electric coil wound around the magnet.

BRIEF DESCRIPTION OF THE DRAWINGS

The present invention will be made more apparent from the ensuing description, reference being made to the accompanying drawings, wherein.

DESCRIPTION OF THE PREFERRED EMBODIMENTS

Figure 1:
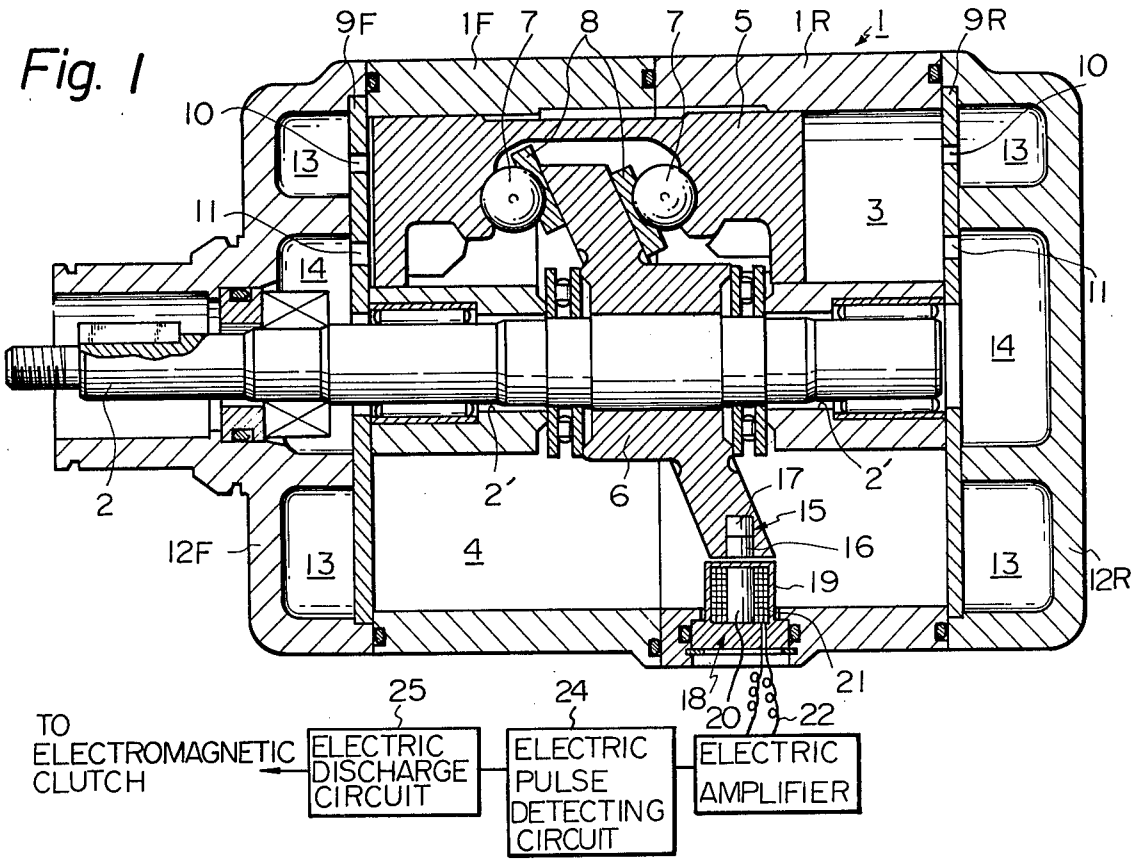
FIG. 1 is a longitudinal cross-sectional view of a swash plate type compressor with a malfunction detector according to one embodiment of the present invention.

Referring to FIG. 1, the swash plate type compressor has a combined cylinder block 1 comprising a front cylinder block 1F and a rear cylinder block 1R combined with each other in an axial alignment via a sealing element. The combined cylinder block 1 forms at its center a through-bore 2'. In the through-bore 2', a drive shaft 2 is rotatably supported by needle bearings. The needle bearings are provided at the outer axial ends of the combined cylinder block 1. The drive shaft 2 is operatively connectable to an automotive engine (not shown) by way of an electromagnetic clutch (not shown) and can be driven by the engine when the electromagnetic clutch is connected.

The combined cylinder block 1 is provided with an appropriate number of axially extending cylinder bores 3 arranged around the central through-bore 2' and with a centrally arranged swash plate chamber 4. In the swash plate chamber 4, a swash plate 6 secured to the drive shaft 2 is rotatably held. The swash plate 6 is made of a thermoconductive, nonmagnetic material, such as aluminum, and is operatively connected via ball bearings 7 and shoes 8 with double-acting multipistons 5 slidably fitted in the cylinder bores 3. Therefore, when the swash plate 6 is rotated by the drive shaft 2, the pistons 5 reciprocate in the cylinder bores 3 and effect the compression action of the compressor.

A front valve plate 9F is attached to the opening end of the front cylinder block 1F and a rear valve plate 9R is attached to the opening end of the rear cylinder block 1R. The front and rear valve plates 9F and 9R are each provided with discharge ports 10 and suction ports 11 connected to the cylinder bores 3.

The combined cylinder block 1 is accompanied by a pair of front and rear cylinder housings 12F and 12R attached to the front and rear cylinder blocks 1F and 1R, respectively, via respective front and rear valve plates 9F and 9R. The front and rear cylinder housings 12F and 12R have suction chambers 14 connected to the suction ports 11 of their corresponding valve plates 9F and 9R and discharge chambers 13 connected to the discharge ports 10 of their corresponding valve plates 9F and 9R, respectively.

The swash plate 6 is provided with a detected unit 15 arranged at part of the outer periphery of the swash plate 6. The detected unit 15 comprises a thermosensor 16, such as thermosensitive ferrite, and a permanent magnet element 17. The thermosensor 16 is disposed in the swash plate 6 so that a part of the thermosensor 16 appears on the surface of the outer periphery of the swash plate 6. The permanent magnet element 17 is embedded in a position inward of the thermosensor 16.

In the rear cylinder block 1R, a detecting unit 18 is fixedly mounted at a position where it is able to stand face to face with the detected unit 15 once per revolution of the swash plate 6. The detecting unit 18 has a cylindrical casing 19 closed at one end, a permanent magnet 20 in the casing 19, and a coil 21 wound around the permanent magnet 20. The casing 19 may be made of molded plastics. Lead wires 22 are led from the coil 21 and are connectable via an electric amplifier 23 to an electric pulse detecting circuit 24. The electric pulse detecting circuit 24 is connected to an electric discharge circuit 25 which is capable of operating as a means for disconnecting the electromagnetic clutch.

At this stage, it should be understood that the permanent magnet element 17 of the detected unit 15 and the permanent magnet 20 of the detecting unit 18 are arranged in such a manner that their magnetic poles are opposed to one another when the detected unit 15 stands face to face with the detecting unit 18, e.g., the N pole of the permanent magnet element 17 is opposed to the S pole of the permanent magnet 20.

The operation of the malfunction detector comprised of the above-mentioned detected unit 15 and detecting unit 18 will be described hereinbelow with reference to FIGS. 1 through 4.

In the swash plate type compressor of FIG. 1, the drive shaft 2 is driven by the automotive engine when the electromagnetic clutch (not shown in FIG. 1) between the compressor and automotive engine is connected. When the drive shaft 2 rotates, the swash plate 6 secured to the drive shaft 2 in the swash plate chamber 4 also rotates. The rotation of the swash plate 6 causes reciprocal motion of the pistons 5 in the cylinder bores 3 via the ball bearings 7 and the shoes 8. The reciprocal motion of the pistons 5 compresses the refrigerant gas introduced into the compressor from the air-conditioning equipment and sends the compressed refrigerant gas out of the compressor toward the air-conditioning equipment.

Figure 2:
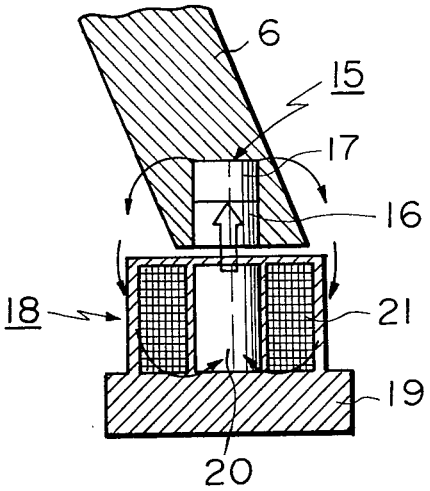
FIGS. 2 through 4 are enlarged partial views illustrating the operation of the malfunction detector of FIG. 1.
Figure 3:
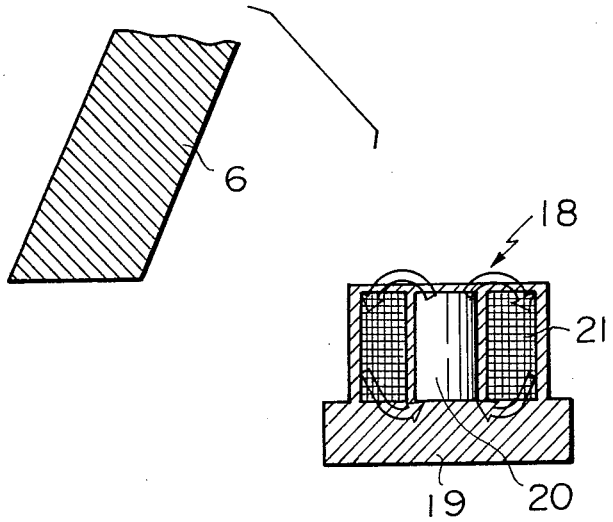
Figure 4:
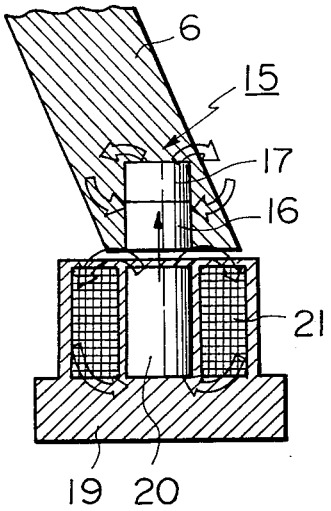

When the swash plate 6 rotates about the axis of the drive shaft 2, the detected unit 15 mounted on the periphery of the swash plate 6 comes face to face with the detecting unit 18 fixed to the rear cylinder block 1R once per revolution of the swash plate 6. The approach of the detected unit 15 to the detecting unit 18 creates a flow of magnetic flux between the permanent magnet 20 of the detecting unit 18 and the permanent magnet element 17 of the detected unit 15, as shown in FIG. 2. When the detected unit 15 goes past the detecting unit 18, as shown in FIG. 3, the density of the magnetic flux decreases.

Therefore, during each revolution of the swash plate 6, there occurs a strong change in the density of the magnetic flux passing through the permanent magnet 20 of the detecting unit 18. The resultant electromagnetic induction creates an electric current in the coil 21 of the detecting unit 18. This electric current issues from the coil 21 in the form of electric voltage pulses, the number of which per unit time (the frequency of the electric voltage pulses) is proportional to the speed of the swash plate 6. The electric voltage pulses are supplied to the electric amplifier 23 where they are amplified and then sent on to electric pulse detecting circuit 24 for electrical processing.

When the compressor is running normally, i.e., when there are no malfunctions in the compressor, such as breakage of pistons 5 due to the liquid compression or an abnormal rise of the temperature within the swash plate chamber 4 beyond the Curie temperature due to insufficient refrigerant gas and lubricating oil, the electric voltage pulses are constantly issued and the connection of the electromagnetic clutch is retained.

If the supply of the refrigerant gas becomes insufficient, however, the resultant insufficient supply of lubricating oil causes the moving elements and parts of the compressor to generate increased friction heat within the compressor. The insufficiency of the supply of the refrigerant gas itself further makes it impossible to prevent this temperature rise within the compressor. The subsequent rise in the temperature of the swash plate 6 brings along with it an increase in the temperature of the thermosensor 16 embedded therein. When the temperature of the thermosensor 16 increases beyond the Curie temperature (between 80° C. to 220° C. depending on the kind of thermosensor 16), the magnetic property of the thermosensor 16 declines or disappears. Therefore, even if the detected unit 15 is brought close to the detected unit 18 by the rotation of the swash plate 6, no appreciable magnetic flux appears between the permanent magnet element 17 and the permanent magnet 20. That is, during the rotation of the swash plate 6 and the detected unit 15, there is no appreciable change in the density of the magnetic flux flowing in the permanent magnet 20 of the detecting unit 18. As a result, no electric voltage pulse is generated by the detecting means 18. Therefore, the pulse detector 24 detects no electric voltage pulses. Consequently, the pulse detector 24 operates the electric discharge circuit 25 to issue a signal to disconnect the electromagnetic clutch. The disconnection of the electromagnetic cluth automatically stops the swash plate type compressor to prevent seizure of the compressor.

Further, at the start of operation of the compressor, the compressor is sometimes subjected to a liquid compression operation. Such a liquid compression operation subjects the pistons 5 to an excessive load and may possibly cause breakdown of the piston 5. As a result, the compressor eventually becomes inoperative. If such an inoperative condition of the compressor occurs, no rotation of the swash plate 6 will take place. Therefore, the detecting unit 18 does not generate any electric voltage pulses. Failure to generate electric voltage pulses is immediately detected by the electric pulse detecting circuit 24, which then operates the electric discharge circuit 25 to issue a signal to disconnect the electromagnetic clutch. Thus, disconnection of the electromagnetic cluth is ensured. Consequently, no drive force is transmitted from the automotive engine to the swash plate type compressor, and the auxiliary elements driven by the same automotive engine can be safeguarded.

Figure 5:
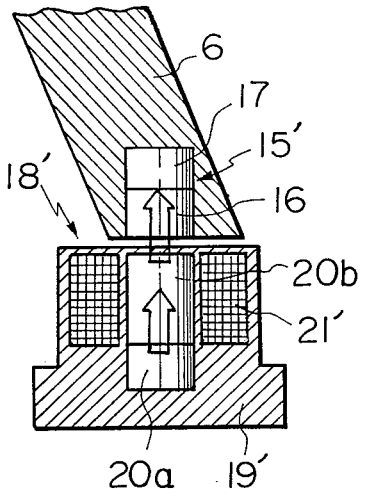
FIGS. 5 through 7 are similar enlarged partial views illustrating the operation of a malfunction detector according to another embodiment of the present invention.
Figure 6:
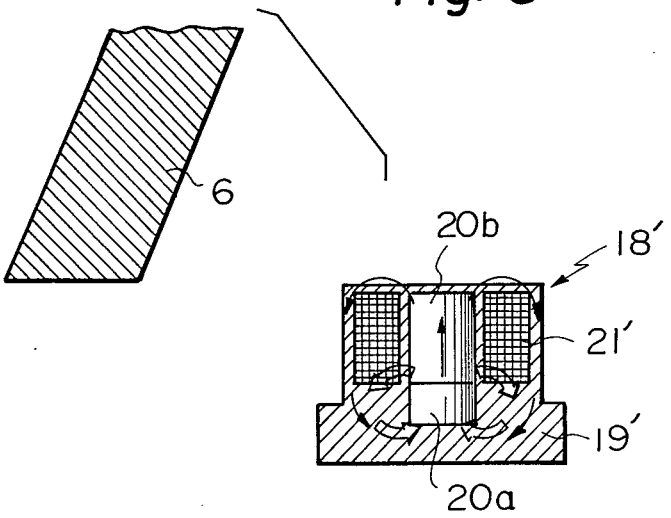
Figure 7:
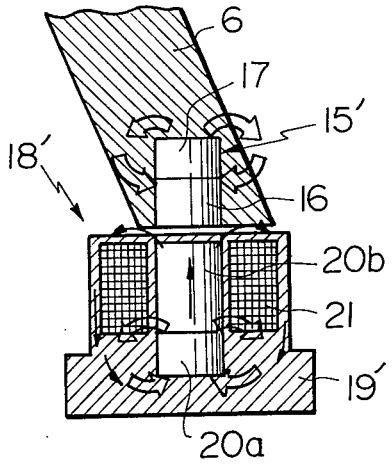

Referring to FIGS. 5 through 7, illustrating another embodiment of the present invention, the detected unit 15' has the same construction and arrangement as the detected unit 15 of FIGS. 1 through 4. The detecting unit 18' fixedly mounted on the rear cylinder block 1R, however, is comprised of a cylindrical casing 19' having therein a closed chamber, a permanent magnet **20*a* arranged in the bottom of the closed chamber, an iron core 20*b* integrally connected to the permanent magnet 20*a*, and a coil 21' wound around the iron core 20*b*. The iron core 20*b* is arranged in the cylindrical casing 19' in such a manner that when the detected unit 15' comes face to face with the detecting unit 18', the iron core 20*b* is in alignment with and opposed to the thermosensor 16**, consisting of a thermosensitive ferrite element.

The operation of the malfunction detector comprised of the detected unit 15' and the detecting unit 18' of FIGS. 5 through 7 is similar to that of the afore-mentioned malfunction detector of FIGS. 1 through 4. That is, when the detected unit 15' is brought close to the detecting unit 18' by the rotation of the swash plate 6, a flow of magnetic flux appears between the permanent magnet element 17 and permanent magnetic **20*a* via the iron core 20*b* and the thermosensor 16. When the detected unit 15' goes past the detecting unit 18', the density of the magnetic flux passing through the iron core 20*b* diminishes or disappears. As a result, during the rotation of the swash plate 6, electric voltage pulses are derived from the coil 21'**.

In the embodiment of FIGS. 5 through 7, however, since the iron core **20*b* is arranged adjacent to the permanent magnet 20*a* so as to operate as a magnetic flux path means and since the coil 21' is wound around the iron core 20*b*, the density of the magnetic flux passing through the coil 21' when the detected unit 15' approaches the detecting unit 18' is higher than that in the case of the coil 21 of FIGS. 1 through 4. On the other hand, when the detected unit 15' goes past the detecting unit 18', the density of the magnetic flux passing through the coil 21' becomes lower than that in the case of the coil 21. Therefore, in the embodiment of FIGS. 5 through 7, it is possible to realize a strong change in the density of the magnetic flux passing through the coil 21' of the detecting unit 18' during the rotation of the swash plate 6. As a result, clearer electric voltage pulses can be derived from the detecting unit 18'** of the malfunction detector. Accordingly, detection of the malfunction of the compressor is made easier.

Figure 8:
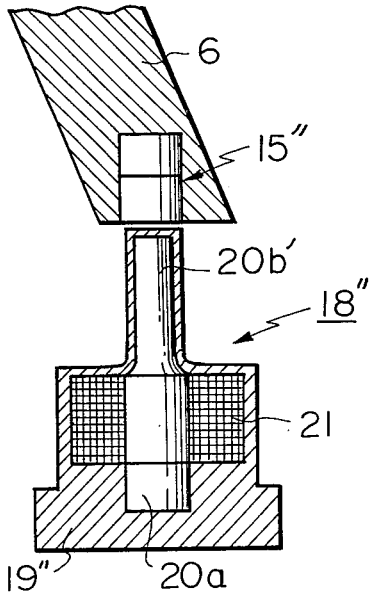
FIG. 8 is an enlarged view of a malfunction detector according a further embodiment of the present invention.

FIG. 8 illustrates a further embodiment of the malfunction detector, in which an extended iron core **20*b'* is employed for the detecting unit 18''. A casing 19'' is formed so as to encase the extended iron core 20*b'*. The permanet magnet 20*a* and the coil 21' of the embodiment of FIGS. 5 through 7 are used for the detecting means 18'' without any alternation in construction and arrangement. The detected unit 15'' is the same as the detecting unit 15 or 15'. The detecting unit 18'' of FIG. 8 is adopted in the case where it has to be mounted on a bulged part of the rear cylinder block of the swash plate type compressor. The operation of the malfunction detector of FIG. 8 is therefore similar to that of the malfunction detector of FIGS. 5 through 7**.

From the foregoing description of diverse embodiments, it will be fully understood that, according to the present invention, the detection of any malfunction of the swash plate type compressor can be ensured and, as a result, automatic and immediate stopping of the transmission of a drive force from an automotive engine to the compressor can be carried out, whereby not only breakdown of the compressor, but also breakdown of auxiliary equipment driven by the same automotive engine can be effectively avoided.

We claim:

1. A swash plate type compressor with a malfunction detector, including a combined cylinder block comprising a pair of front and rear cylinder blocks axially combied with each other; a rotatable drive shaft centrally extending through said combined cylinder block, said rotatable drive shaft being connectable to a drive source via an electromagnetic clutch; a plurality of cylinder bores formed in said combined cylinder block so as to be arranged around said rotatable drive shaft; a plurality of compressor pistons slidably fitted in said plurality of cylinder bores; a swash plate chamber in the approximately middle portion of said combined cylinder block; and a swash plate in said swash plate chamber rotatably supported on said drive shaft, said swash plate causing reciprocal motions of said compressor pistons, wherein said malfunction detector comprises: a detected means having a thermosensitive element embedded in part of an outer periphery of said swash plate and a permanent magnet element embedded inwardly from and arranged adjacent to said thermosensitive element; and a detecting means having a fixed magnet means fixedly arranged in said combined cylinder block at a position where said detecting means comes face to face with said detected means once per each revolution of said swash plate, and an electric coil wound around said magnetic means, and adapted for issuing an electrical signal in response to increase of magnetic flux density on each approach of said permanent magnet of said detected means to said fixed magnetic means thereof during rotation of said swash plate, said thermosensitive element of said detected means being arranged for normally, magnetically coupling said permanent magnet to said fixed magnetic means of said detecting means on each said approach of said permanent magnet to said fixed magnetic means thereby to cause a large increase of magnetic flux density, and for magnetically decoupling said permanent magnet from said fixed magnet means when the temperature of the compressor is excessive.

2. A swash plate type compressor according to claim 1, wherein said electric coil of said detecting means of said malfunction detector is provided with electric wire means connectable to an electric signal processing circuit means.

3. A swash plate type compressor according to claim 1, wherein said permanent magnet element of said detected means of said malfunction detector is integrally connected to said thermosensitive element.

4. A swash plate type compressor according to claim 3, wherein said thermosensitive element comprises a thermosensitive ferrite element having an outer end appearing in the surface of said outer periphery of said swash plate.

5. A swash plate type compressor with a malfunction detector, including a combined cylinder block comprising a pair of front and rear cylinder blocks axially combined with each other; a rotatable drive shaft centrally extending through said combined cylinder block, said rotatable drive shaft being connectable to a drive source via an electromagnetic clutch; a plurality of cylinder bores formed in said combined cylinder block so as to be arranged around said rotatable drive shaft; a plurality of compressor pistons slidably fitted in said plurality of cylinder bores; a swash plate chamber in the approximately middle portion of said combined cyclinder block; and a swash plate in said swash plate chamber rotatably supported on said drive shaft said swash plate causing reciprocal motions of said compressor pistons, the improvement being that said malfunction detector comprises a detected means having a thermosensitive element disposed in part of an outer periphery of said swash plate and a permanent magnet element embedded inwardly from and arranged adjacent to said thermosensitive element and comprises a detecting means fixedly arranged in said combined cylinder block at a position where said detecting means comes face to face with said detected means once per each revolution of said swash plate, said detecting means comprising a fixed magnetic means and an electric coil wound around said magnetic means, said fixed magnetic means of said detecting means of said malfunction detector comprising a permanent magnet element and a magnetic core member connected to and extending from said permanent magnet element, said magnetic core member having an end capable of confronting said thermosensitive element of said detected means of said malfunction detector, said electric coil being wound around said magnetic core member.

* * * * *